US005210888A

United States Patent [19]

Canfield

[11] Patent Number: 5,210,888

[45] Date of Patent: May 18, 1993

[54] PORTABLE TENT—COT

[76] Inventor: Michael A. Canfield, 10412 N. 45th Pl., Phoenix, Ariz. 85028

[21] Appl. No.: 904,184

[22] Filed: Jun. 25, 1992

[51] Int. Cl.[5] ..... A47C 17/64

[52] U.S. Cl. ..... 5/113; 5/111; 16/358; 16/390; 297/378

[58] Field of Search ..... 5/113, 111, 110, 114, 5/414, 312; 135/96; 16/390, 358; 297/378

[56] References Cited

U.S. PATENT DOCUMENTS 3,601,825 8/1971 Moorhead et al. ..... 5/113
4,694,517 9/1987 Lin ..... 5/111
4,914,768 4/1990 Howard ..... 5/113
5,018,227 5/1991 Canfield ..... 5/113

*Primary Examiner*—Alexander Grosz
*Attorney, Agent, or Firm*—Tod R. Nissle

[57] ABSTRACT

A cot—tent includes bedding and a tent for covering the bedding. The tent and bedding are supported on a frame which includes a pair of hollow tubular legs, an upright U-shaped tent support, and a pair of hinge members. The tent support and legs are pivotally attached to the hinge members. Each hinge member comprises a pair of interconnected opposing panel portions. Support plugs are inserted in the ends of the tubular legs to strengthen the legs.

2 Claims, 5 Drawing Sheets

PORTABLE TENT—COT

This invention relates to bedding.

More particularly, the invention relates to a cot—tent which is unusually simple to manufacture, use, and store.

In another respect, the invention relates to a cot including hinge components which are lightweight, of simple manufacture, and facilitate the securing in position of legs and other cot components which are pivotally attached to the hinge components.

In a further respect, the invention relates to a cot which can, without fear of structural failure during normal use of the cot, utilize tubular legs having a wall thickness of only 0.035 inches.

Cots and cot—tent structures have existed for many years. See, for example, U.S. Pat. No. 5,018,227 to Canfield. Such cot—tents include a plurality of legs and other components which are pivotally attached to hinge members. A principal difficulty encountered in the manufacture of a such cot—tent structure is that when the materials necessary to impart a sufficient structural strength to the legs and hinge members of the cot are utilized, the manufacture of the cot is made more complicated and costly, and the resulting cot structure is relatively heavy. Reducing the weight of the cot is desirable because it reduces shipping costs and facilitates transport and configuration of the cot by an end user.

Accordingly, it would be highly desirable to provide an improved cot—tent which reduced the cost of manufacture of the legs, hinge members, and other components of the cot, and which reduced the weight of the cot.

Therefore, it is a principal object of the invention to provide improved bedding.

Another object of the invention is to provide an improved cot—tent having lightweight, strong, and simple hinge members and legs.

These and other, further and more specific objects and advantages of the invention will be apparent to those skilled in the art from the following detailed description thereof, taken in conjunction with the drawings, in which.

Figure 1:
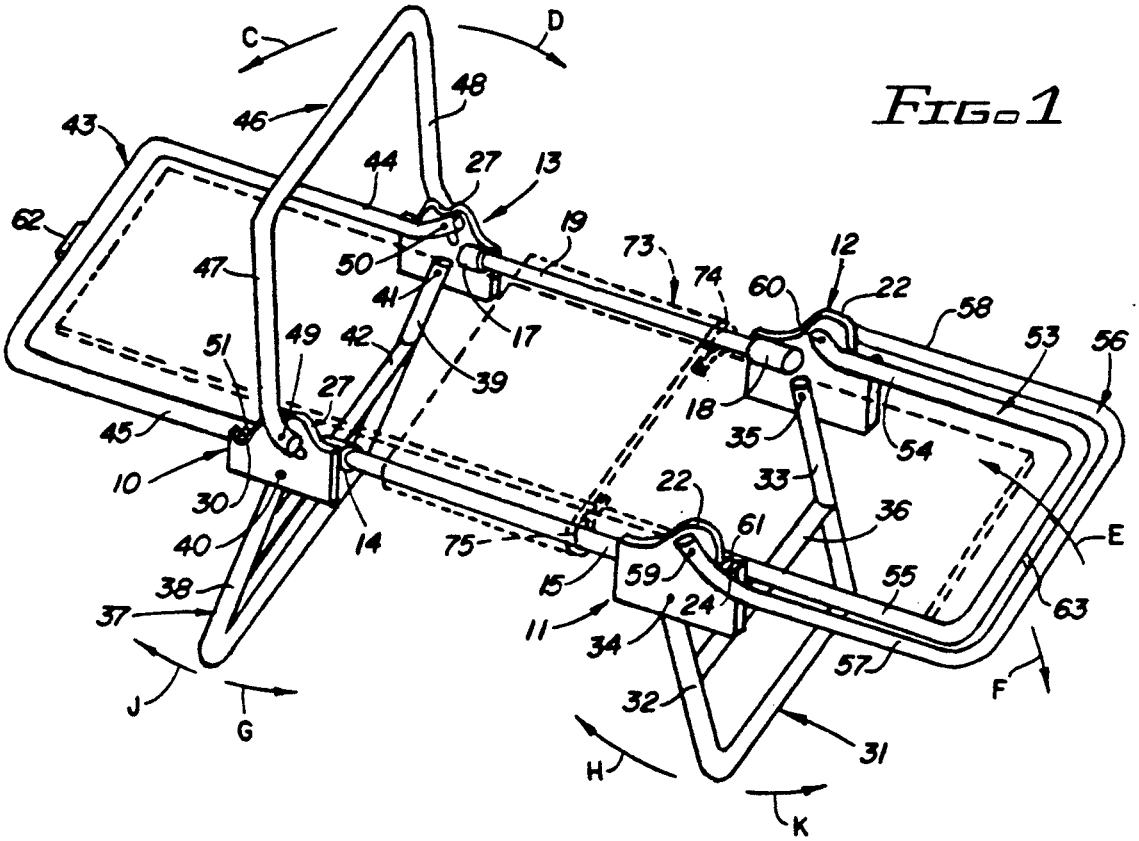
FIG. 1 is a perspective view illustrating the frame of a prior art cot—tent.

Briefly, in accordance with our invention, we provide a bed including bedding means defining a surface for an individual to recline on; pliable tent means at least partially covering the bedding means; and, frame means for supporting the bedding means and tent means above the ground. The frame means includes first and second spaced apart legs, each of the legs having an upper end and a lower ground contacting end; a U-shaped upright tent support having first and second lower ends and supporting a portion of the tent means above and spaced apart from the bedding means; a first hinge member connected to the upper end of the first leg and to the first lower end such that the tent support and the first leg can be pivoted with respect to the first hinge member; and, a second hinge member connected to the upper end of the second leg and to the second lower end such that the tent support and the second leg can be pivoted with respect to the second hinge member. The first and second hinge members each include a pair of interconnected opposing adjacent panel portions.

In another embodiment of the invention, we provide a bed including bedding means defining a surface for an individual to recline on; pliable tent means at least partially covering the bedding means; and, frame means for supporting the bedding means and tent means above the ground. The frame means includes first and second spaced apart legs, each of the legs having a hollow upper end and a lower ground contacting end; a first insert shaped and dimensioned to be slidably received by said hollow upper end of said first leg to strengthen the resistance of the upper end of the first leg to compressive forces; a second insert shaped and dimensioned to be slidably received by the hollow upper end of the second leg to strengthen the resistance of the upper end of the second leg to compressive forces; a U-shaped upright tent support having first and second lower ends and supporting a portion of the tent means above and spaced apart from the bedding means; a first hinge member connected to the upper end of the first leg and to the first lower end such that the tent support and the first leg can be pivoted with respect to the first hinge member; and, a second hinge member connected to the upper end of the second leg and to the second lower end such that the tent support and the second leg can be pivoted with respect to the second hinge member.

In still a further embodiment of our invention, we provide an improved bed including bedding means defining a surface for an individual to recline on; pliable tent means at least partially covering the bedding means; and, frame means for supporting the bedding means and tent means above the ground. The frame means includes first and second spaced apart legs each having an upper end and a lower ground contacting end; a U-shaped upright tent support having first and second lower-ends and supporting a portion of the tent means above and spaced apart from the bedding means; and, a first hinge member connected to the upper end of the first leg and to the first lower end such that the tent support and the first leg can be pivoted with respect to the first hinge member. The first hinge member includes a first arcuate slot extending through the hinge member; a first pin slidably carried in the slot for displacement along the slot when the first leg is moved through an arc from a first storage position to a second extended ground engaging position, the pin extending through and outwardly from the first hinge member and connected to the upper end of the first leg; an aperture extending through the hinge member; and, a second pin mounted for rotation in the aperture when the first leg is moved from the first position to the second position. The second pin is spaced apart from the first pin, extends through and outwardly from the first hinge member, and is connected to the upper end of the first leg.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates the frame of a prior art foldable portable tent—cot and including hinge members 10 to 13. Hinge member 10 is identical to member 13. Hinge member 11 is identical to member 12. Hollow sleeve member 14 is attached to the inner face of member 10. An identical hollow sleeve member 16 (not visible) is attached to the inner face of member 11. The ends of the central tubular strut 15 are slidably received by and fastened with adhesive or other means to sleeve member 14 and to sleeve member 16. Hollow sleeve members 17, 18 are attached to the inner faces of members 13, 12, respectively. The ends of the central tubular strut 19 are slidably received by and secured with adhesive or other means to members 18, 19.

Figure 5:
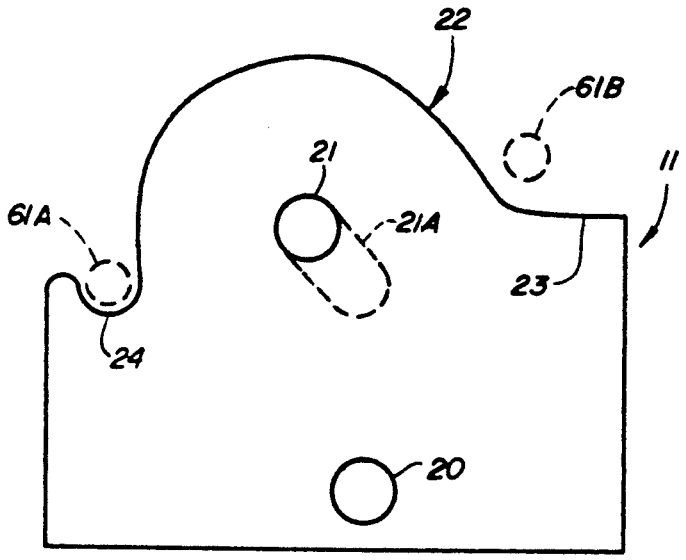
FIG. 5 is a side view illustrating a hinge in the frame of FIG. 1.
Figure 6:
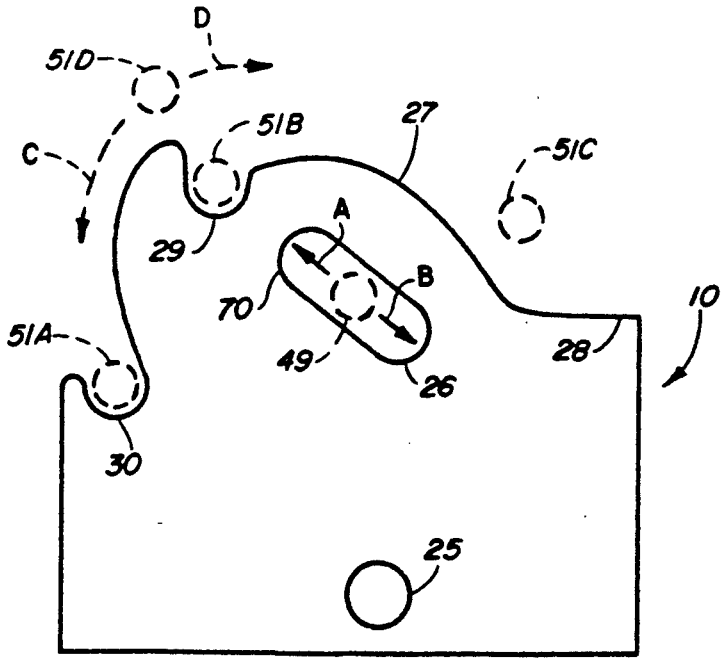
FIG. 6 is a side view illustrating another hinge in the frame of FIG. 1.

Hinge 11 (and consequently hinge 12) includes circular apertures 20 and 21 formed therethrough (FIG. 5). Upper cam surface 22 includes a flat area 23 and a semicircular detent or notch 24. Hinge 10 (and consequently hinge 13) includes circular aperture 25 and elongate slot 26 formed therethrough (FIG. 6). Upper cam surface 27 includes flat area 28, semicircular notch or detent 29, and semicircular notch or detent 30.

In FIG. 1, U-shaped leg 31 includes a first end 32 and a second end 33. Pin 34 is straight and passes through aperture 20 of member 11 and end 32 to pivotally connect end 32 to hinge member 11. Pin 35 is straight and passe through end 33 and aperture 20 of hinge member 12 to pivotally connect end 33 to hinge member 12. Cross brace 36 is connected to leg 31.

U-shaped leg 37 includes a first end 38 and a second end 39. Pin 40 is straight and passes through aperture 25 of member 10 and through end 38 to pivotally connect end 38 to hinge member 10. Pin 41 is straight and passes through end 39 and aperture 25 of hinge member 13 to pivotally connect end 39 to hinge member 13. Cross brace 42 is connected to leg 37.

Outrigger member 43 includes first end 45 and second end 44. Tent support member 46 includes first end 47 and second end 48. Pin 49 is straight and passes through end 47, slot 26 of member 10 and end 45 to pivotally connect ends 47 and 45 to hinge member 10. Pin 50 is straight and passes through end 44, slot 26 of member 13 and end 48 to pivotally connect ends 44 and 48 to member 13. Pin 49 can slide along slot 26 of member 10 in the directions indicated by arrows A and B in FIG. 6. Pin 50 can similarly slide along slot 26 of member 13 in the directions indicated by arrows A and B. Member 46 can be pivoted independently of member 43 about pins 49 and 50 in the directions of arrows C and D in FIG. 1. Member 43 can be pivoted in the directions of arrows C and D. When pins 49 and 50 slide along slots 26 in the direction of arrows A and B, ends 44, 45, 47, 48 also move simultaneously with pins 49 and 50 in the direction of arrows A and B.

Outrigger member 53 includes first end 55 and second end 54. Tent support member 56 includes first end 57 and second end 58. Pin 59 is straight and passes through end 57, aperture 21 of member 11 and end 55 to pivotally connect ends 55 and 57 to hinge member 11. Pin 60 is straight and passes through end 54, aperture 21 of member 12, and end 58 to pivotally connect ends 54 and 58 to member 12. Member 56 can be pivoted independently of member 53 about pins 59 and 60 in the direction of arrow E. After being pivoted in the direction of arrow E, members 53 and 56 can be pivoted about pins 59 and 60 in a direction opposite that of arrow E to return members 53 and 56 to the position illustrated in FIG. 1. Members 53 and 56 are shaped and dimensioned such that member 53 fits with or nests in member 56 both when member 56 is in the position shown in FIG. 1 and when members 53 and 56 are in the folded configuration shown in FIG. 4. Similarly, members 43 and 46 are shaped and dimensioned such that member 43 can nest in member 46, both when members 43 and 46 are in the folded configuration shown in FIG. 4 and when member 43 is in the position shown in FIG. 1. If, in FIG. 1, member 46 is pivoted in the direction of arrow C to a position adjacent to the position of member 43 in FIG. 1, then member 43 is nested inside member 46.

In FIG. 1, pin 51 is fixedly attached to and outwardly extends from end 45. Pin 51 is nested in detent 30. An identical companion pin 51 (not visible) is attached to and extends outwardly from end 44 and is nested in detent 30 of member 13. Pin 61 is fixedly attached to and outwardly extends from end 55. Pin 61 is nested in detent 24. A identical companion pin 61 (not visible) is fixedly attached to an extends outwardly from end 54 and is nested in detent 24 of member 12. When member 43 is pivoted in the directions indicated by arrows C and D, pins 51 ordinarily will not, unless nested in detent 30, contact cam surface 27. Similarly, when member 53 is pivoted in the direction of arrow E or in a direction opposite arrow E, pins 61 ordinarily will not contact cam surfaces 22 unless pins 61 are nested in detents 24. If desired, cam surfaces 22 and 27 can be shaped and dimensioned such that pins 51 and 61 slide along at least a portion of the surfaces while members 43 and 53 are being pivoted to move pins 51 and 61 to and from detents 24, 29, and 30.

In FIG. 1, tab 63 is connected to and outwardly extends from member 53. Tab 63 is sized such that it contacts member 56 and prevents member 56 from moving past member 53 in the direction of arrow F. Similarly, tab 62 is connected to and outwardly extends from member 43. Tab 62 is sized such that if in FIG. 1 member 46 is, while member 42 is maintained stationary, pivoted about hinges 10, 12 in the direction of arrow C, member 46 will contact tab 62 and tab 62 will then prevent member 46 from moving downwardly past member 43 in the direction of arrow C.

Figure 4:
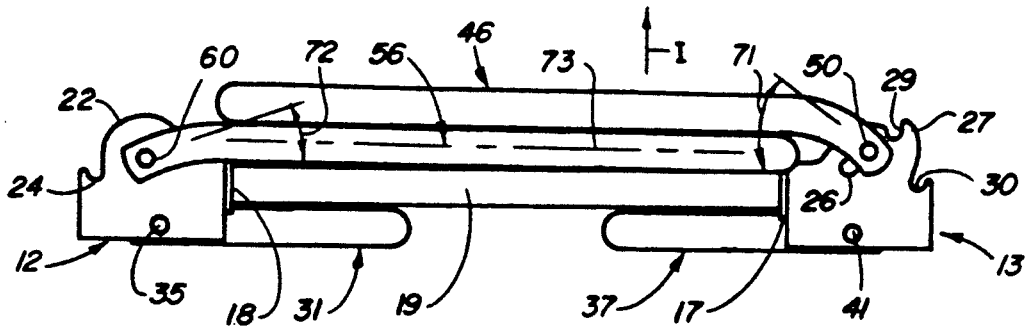
FIG. 4 is a side view illustrating the frame of FIG. 1 after the frame has been folded for storage.

The bed of FIG. 1 is folded to the storage configuration by pivoting legs 37 and 31 in the direction of arrows G and H, respectively; by pivoting members 43 and 46 in the direction of arrow D; and, by pivoting members 53 and 56 in the direction of arrow E. The folded storage configuration is illustrated in FIG. 4. When the bed is in the storage configuration, pin 61 on end 55 is in the position illustrated by dashed lines 61B in FIG. 5 and pin 51 on end 45 is in the position illustrated by dashed lines 51C in FIG. 6. When the fabric tent structure is mounted on the frame of FIG. 1, the bed of the invention has the appearance shown in FIG.

Figure 2:
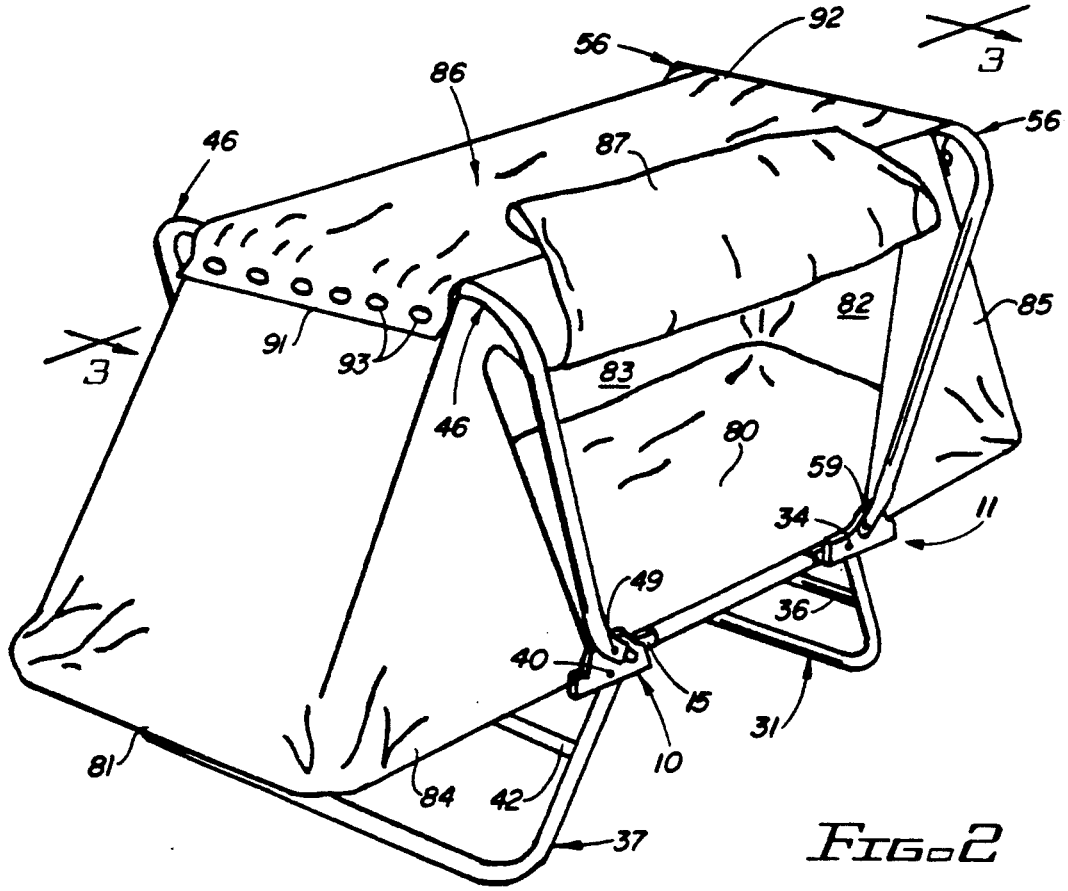
FIG. 2 is a perspective view illustrating the frame of FIG. 1 after pliable fabric material defining the walls of the tent and floor of the cot have been mounted on the frame.

2. The orientation of the frame members in FIG. 2 is identical to the orientation of the frame members in FIG. 1, except that in FIG. 2 member 56 is pivoted upwardly in the direction of arrow E from the position of member 56 shown in FIG. 1. When members 53, 56, 43, 46, 31, 37 are in the orientation of FIG. 2, pin 61 on end 55 is in the position illustrated by dashed lines 61A in FIG. 5 and pin 51 on end 45 is in the position illustrated by dashed lines 51A in FIG. 6.

The frame of FIG. 1 can be configured to be utilized as a lounge chair by moving member 43 upwardly in the direction of arrow D from the position illustrated in FIG. 1. When this upward movement is being carried out, member 43 is moved in the direction of arrow D until it is adjacent with member 46 in FIG. 1, i.e., member 43 is moved in the direction of arrow D until it is partially upright. When member 43 is in this partially upright position, pins 49, 50 are positioned in slots 26 in a location corresponding to the farthest possible point of travel of the pins in the direction of arrow A in slot 26. In other words, pins 49, 50 are positioned in the upper ends 70 of slots 26. Members 43 and 46 are then pushed downwardly in the direction of arrow B. This causes pins 49, 50 to slide along slots 26 in the direction of arrow B until pins 49, 50 are at the bottom of slots 26. When pins 49, 50 are at the bottom of slots 26, pins 51 are seated in detents 29 and pins 51 are each in the position indicated by dashed lines 51B in FIG. 6 and members 43 and 46 are in the lounge chair configuration. Members 43 and 46 can be removed from the lounge chair configuration by pulling members 43 and 46 in the direction of arrow A. When members 43 and 46 are pulled in the direction of arrow A, pins 49, 50 slide upwardly along slots 26 in the direction of arrow A until pins 49, 50 contact the upper ends 70 of slots 26. When pins 49, 50 are at the upper ends 70 of slots 26, pins 51 are each in the position indicated by dashed lines 51D in FIG. 6. When pins 51 are in the position indicated by dashed lines 51D, then members 43 and 46 can be rotated in the directions indicated by arrows C and D.

The angle 71 in FIG. 4 is greater than the angle 72. This means that the distal end of member 56 connected to pin 60 is bent less from the longitudinal axis 73 than is the distal end of member 46 connected to pin 50. The more significant bend in the distal end of member 46 enables member 46 to extend up and over member 56 in the manner shown in FIG. 4 so that member 46, member 56, member 19, and legs 31 and 37 are parallel to one another when the frame of FIG. 1 is folded. Slot 26 also facilitates the ability of member 46 to move or slide upwardly in the direction of arrow I so that member 46 can be positioned parallel to member 56. The degree of bend of the distal end of member 46 attached to pin 49 is equivalent to the amount of bend in the distal end of member 46 attached to pin 50. The amount of bend of the distal end of member 56 attached to pin 59 is equivalent to the amount of bend in the distal end of the member 56 attached to pin 60. To facilitate the compact folding of members 53 and 56, a slot 21A can be formed in each member 11 and 12 in place of aperture 21.

Figure 3:
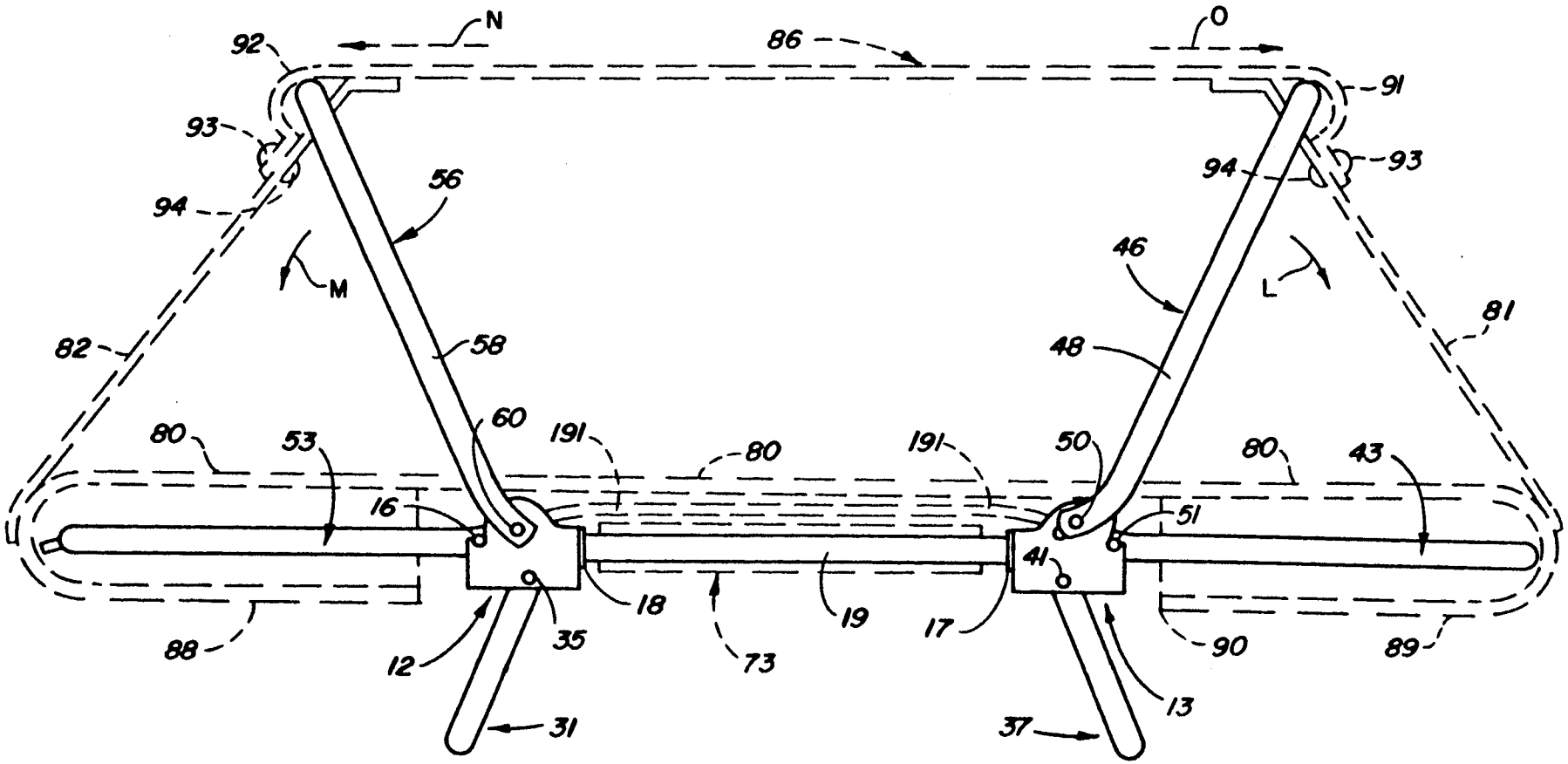
FIG. 3 is a side view of the cot—tent of FIG. 2 further illustrating in ghost outline the mounting of fabric material on the cot frame where the fabric material in FIG. 3 is seen along section line 3—3 in FIG. 2.

The fabric tent structure carried on the frame of FIG. 1 is illustrated in FIGS. 2 and 3. FIG. 3 is a rear view of the cot—tent of FIG. 2 with the fabric tent structure being shown in a ghost outline taken along section line 3—3 in FIG. 2.

The fabric tent structure includes a rectangular pliable fabric floor panel 80; end panels 81 and 82; back panel 83; front side panel 84; front side panel 85; roof panel 86; door panel 87; and sub—floor panels 88 and 89. Panels 80 to 89 are sewn together or otherwise integrally formed or interconnected to form a unitary fabric tent structure mountable on the frame of FIG. 1. Each sub—floor panel 88 and 89 is attached to floor panel 80 to form a unitary fabric tent structure mountable on the frame of FIG. 1. Each sub—floor panel 88 and 89 is attached to floor panel 80 to form a pocket which slidably fits over either member 43 or member 53. Leading edge 90 of sub—floor panel 89 defines, in part, the mouth of the pocket formed between panel 89 and panel 80. Roof panel 86 includes ends 91 and 92 which extend over the upper portions of members 46 and 56, respectively. Each end 91 and 92 includes a plurality of male snap members. A plurality of opposing female snap members 94 is mounted in end panels 81 and 82. The fabric tent structure of FIGS. 2 and 3 is removably secured to member 46 and 56 by extending ends 91 and 92 over members 46 and 56 in the manner shown in FIG. 3 and then snapping together opposing male 93 and female 94 members. In FIG. 3, the force of gravity acts on members 46 and 56 and tends, along with the weight of the fabric tent structure bearing down against members 46 and 56, to pull members 46 and 56 in the direction of arrows L and M, respectively. When the force of gravity and other forces pull members 46 and 56 in the direction of arrows L and M, roof panel 86 is pulled and tensioned in the direction of arrows O and N. Since roof panel 86 is not elastic, or is elastic but only stretches a selected amount under the forces pulling members 46 and 56 in the direction of arrows L and M, once panel 86 is tensioned it maintains members 46 and 56 in the upright orientation shown in FIG. 3.

The fabric tent structure of FIGS. 2 and 3 is installed on the frame of FIG. 1 by pivoting members 43 and 53 to a generally upright orientation, i.e., by pivoting members 43 and 53 to an orientation similar to that of member 46 in FIG. 1. The pockets formed by sub—floor panels 88 and 89 and floor panel 80 are then slid over members 43 and 53 such that the fabric tent structure and panel 80 pass through and under members 46 and 56 and such that panel 80 is above panels 88 and 89. Members 43 and 53 are then pivoted in the direction of arrows C and F, respectively, in FIG. 1 until members 43 and 53 are in the orientation shown in FIGS. 1, 2, and 3. When members 43 and 53 are in the orientation of FIG. 3, floor member 80 is tensioned and flattened. Member 46 is, while members 43 and 53 remain in the positions shown in FIG. 3, pivoted to the upright position of FIG. 1. End 91 is pulled over member 46 in the manner shown in FIG. 2 and the male snap members 93 are connected to the female snap members in panel 81. Member 56 is then moved to an upright orientation generally corresponding to the orientation shown in FIG. 3 and end 92 is pulled over the upper portion of member 56 in the manner shown in FIGS. 2 and 3 and the male snap members 93 in end 92 are attached to the female snap members in end panel 82. After the door panel 87 is rolled onto the roof panel 86, the fabric tent structure is then positioned on the frame in the manner shown in FIG. 2. The cot—tent of FIG. 2 is readily converted to a simple cot by disconnecting all snap members 93 from opposing members 94 and allowing panels 81, 82, 83, 84, 85, and 86 to fall onto floor panel 80. After members 46 and 56 are lowered to horizontal positions similar to that of member 56 in FIG. 1, the cot—tent of FIG. 2 provides a horizontal support surface and can be utilized as a cot. Once the cot—tent of FIG. 2 is partially disassembled in the manner just described to serve as a cot, it can be adapted to serve as a lounge chair by raising member 43 to an upright position in which pins 51 are, as earlier described, seated in detents 29 of members 10 and 13.

In FIG. 3 a rectangular thermal insulation pad or laminate is shown by dashed lines 191.

Figure 7:
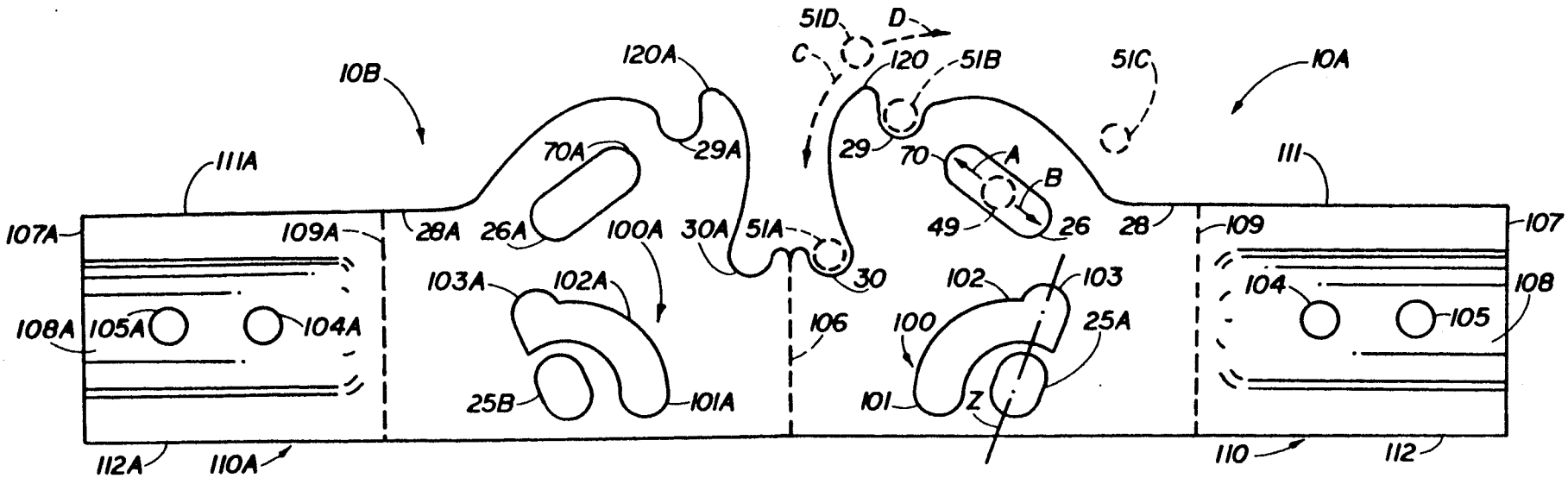
FIG. 7 is a side view illustrating a hinge constructed in accordance with the invention.
Figure 8:
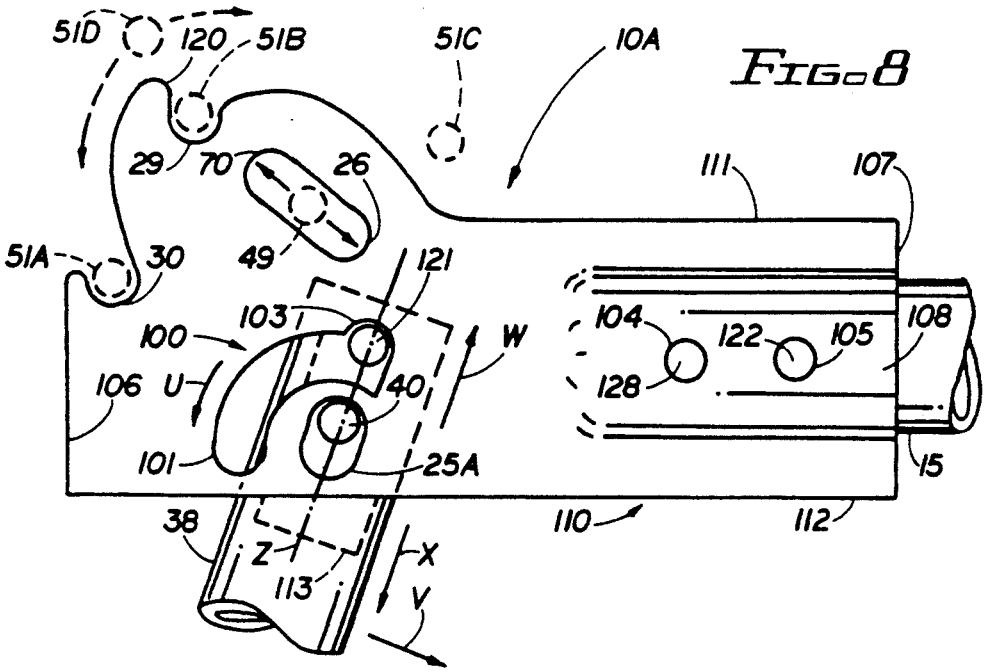
FIG. 8 is a side view of the hinge of FIG. 7 after the mirror image halves of the hinge are folded together and a cot leg and support strut are mounted on the hinge.
Figure 9:
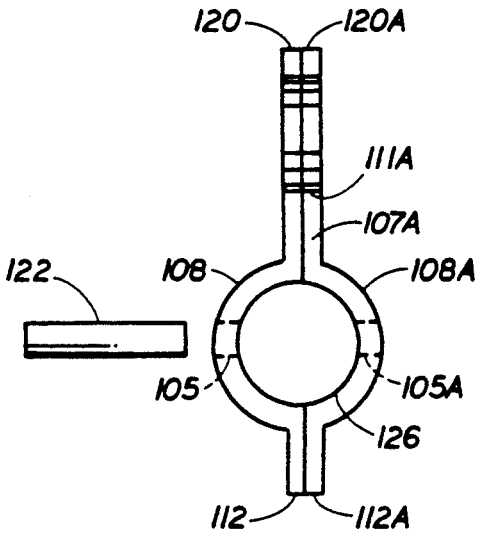
FIG. 9 is a front view of the hinge of FIG. 8.

The improved hinge member of the invention is illustrated in FIGS. 7 to 9 and includes hinge portions 10A and 10B. In FIG. 7, hinge portion 10B is the mirror image of hinge portion 10A. Hinge portion 10A is identical to hinge member 10 in FIG. 6 except that wing member 110 to the left of dashed line 109 in FIG. 7 has been added to member 10, circular aperture 25 in member 10 has been lengthened to form oval aperture 25A, and arcuate aperture 100 has been formed through portion 10A. Wing member 110 includes semi-cylindrical indent 108, apertures 104 and 105 formed through indent 108, end edge 107, upper edge 111, and lower edge 112. Similarly, wing member 110A of hinge portion 10B includes semi-cylindrical indent 108A, apertures 104A and 105A formed through indent 108A, end edge 107A, upper edge 111A, and lower edge 112A. An important advantage of the hinge member of FIG. 7 is that it can be readily stamped and/or cut from a single metal sheet. Since the hinge member of FIG. 7 is usually stamped from a thin metal plate, the thickness 200 (FIG. 9) of the hinge member is about the same at all points on the hinge member. In use of the hinge member of FIG. 7, the member is folded along line 106 such that portions 10A and 10B contact and are opposed to one another in the manner illustrated in FIGS. 8 and 9.

As illustrated in FIGS. 8 and 9, semi-cylindrical indents 108 and 108A are shaped and dimensioned such that the folded hinge member of FIGS. 8 and 9 forms a cylindrical aperture which, when the hinge member of FIG. 7 is utilized in place of member 10 (or 13), slidably receives one end of strut 15 or 19. After strut 15 is inserted in aperture 126 in the manner illustrated in FIG. 8, one pin 122 is inserted and extends through aperture 105, through an aperture (not visible) formed through strut 15, and through aperture 105A. A second pin 128 is inserted and extends through aperture 104, through an aperture (not visible) formed through strut 15, and through aperture 104A. Pins 122 and 128 function to secure one end of strut 15 in the hinge member and also function to hold portions 10A and 10B together. FIG. 9 illustrates the hinge member of FIG. 8 without leg 38 and strut 15 is attached to the hinge member.

When the hinge of FIG. 7 is utilized in place of hinge 10, an additional pin 121 is attached to and extends outwardly from the upper end 38 of leg 37. As shown in FIG. 8, pin 121 is spaced apart from and parallel to pin 40. In FIGS. 1, 2, 3, and 8 leg 37 is illustrated in its extended ground engaging position. In FIG. 8, pin 121 is seated in detent 103 of arcuate groove 100—100A. Pin 40 is positioned in the upper end of elongate aperture 25A. In order to move leg 37 from the position shown in FIG. 8 to the storage position illustrated in FIG. 4, leg 37 and upper end 38 are pulled outwardly in the direction of arrow X in FIG. 8 such that pin 40 slides along aperture 25A in the direction of arrow X and such that pin 121 unseats from detent 103 and move in the direction of arrow X into arcuate slot 100. The lower portion of leg 37 is then pivoted in the direction of arrow V such that pin 121 slides along arcuate slot 100 in the direction of arrow U until pin 121 seats in the lower end 101 of slot 100. In order to move leg 37 from the storage position back to the extended position illustrated in FIG. 8, the reverse procedure is used and pin 121 slides along slot 100 in a direction opposite that of arrow U and, when pin 121 is positioned directly beneath detent 103, pin is upwardly displaced 121 and leg 38 are upwardly direction of arrow W to seat in detent 103. When the leg 37 is in the extended position of FIG. 8, the weight of the hinge member bears down against pins 40 and 121 and locks pin 121 in position in detent 103.

Figure 10:
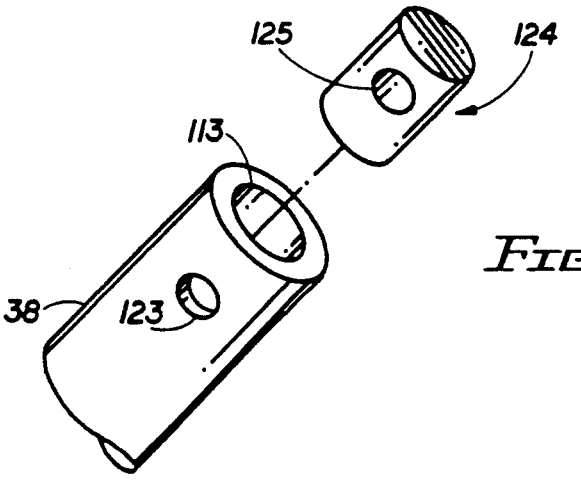
FIG. 10 is a perspective exploded view of a cot leg and the strengthening member used in the upper end of the leg.

When cot—tent of FIG. 1 is assembled, the resulting unit can be relatively heavy, which increases to the cost of shipping and make the unit more difficult for the end user to handle. Consequently, it is desirable that the members 43, 46, 15, 19, 53, 56, 31, and 37 be constructed of thin-walled hollowed tubing in order to reduce the weight of the unit. When, however, thin-walled tubing is utilized, the risk of structural failure increases, particularly in the legs. In order to facilitate the use of hollow tubing, a plug 124 is utilized which is shaped and dimensioned to be slidably received by the inner hollow area 113 of the end 38 of a leg 37 or by the inner hollow area of the ends of any of members 43, 46, 15, 19, 53, 56, 31, and 37. In FIG. 10, apertures 123 and 125 are shaped and dimensioned to slidably receive one end of pin 40 which extends through apertures 123 and 125 and through another sister aperture (not visible) in end 38 which is collinear with apertures 123 and 125 and which, with aperture 123, brackets plug 124. The other end of pin 40 extends outwardly from end 38 into aperture 40. In the presently preferred embodiment of the invention, legs 31 and 37 are fabricated from tubular steel having a wall thickness of 0.035 inch and plugs 124 are fabricated from plastic, which increases the resistance of legs 31, 37 to compressive forces and makes legs 31 and 37 inexpensive, lightweight, and strong. As would be appreciated by those of skill in the art, leg 37 (and leg 31) can be thought of as two separate legs 38, 39 each hinge an upper end attached to a hinge member 10 or 13 and having a lower ground engaging end.

Having described the presently preferred embodiment of our invention in such terms as to enable those skilled in the art to understand and practice it, and having identified the presently preferred embodiments thereof, I Claim:

1. A bed including (a) bedding means defining a surface for an individual to recline on;

(b) pliable tent means at least partially covering said bedding means;

(c) frame means for supporting said bedding means and tent means above the ground and including (i) first (38) and second (39) spaced apart legs, each of said legs having an upper end and a lower ground contacting end, (ii) a U-shaped upright tent support having first and second lower ends and supporting a portion of said tent means above and spaced apart from said bedding means, (iii) a first hinge member connected to said upper end of said first leg and to said first lower end such that said tent support and said first leg can be pivoted with respect to said first hinge member, said first hinge member including a first arcuate slot (100, 100A) extending through said hinge member, a first pin (121) slidably carried in said slot for displacement along said slot when said first leg is moved through an arc from a first storage position to a second extended ground engaging position, said pin extending through and outwardly from said first hinge member and connected to said upper end of said first leg, an aperture (25A) extending through said hinge member, a second pin (40) mounted for rotation in said aperture when said first leg is moved from said first position to said second position, spaced apart from said first pin, extending through and outwardly from said first hinge member, and connected to said upper end of said first leg.

2. The bed of claim 1

(a) including a detent (103) opening on and extending outwardly from said arcuate slot; and, (b) wherein said aperture (25A) is shaped and dimensioned to permit said second pin to slide along an axis passing through said detent such that when said first leg is in said second extended position, said second pin can be slid along said aperture toward said detent and said first pin (121) can be slid from said arcuate slot into said detent (103) to seat said first pin in said detent and secure said first leg in said second extended position.

* * * * *